US006147354A

United States Patent [19]

Maishev et al.

[11] Patent Number: 6,147,354

[45] Date of Patent: Nov. 14, 2000

[54] UNIVERSAL COLD-CATHODE TYPE ION SOURCE WITH CLOSED-LOOP ELECTRON DRIFTING AND ADJUSTABLE IONIZATION GAP

[76] Inventors: Yuri Maishev, Russian Confederation 113204 Samskoy Proezd 21, Bldg. 1, Apt. 43, Moscow, Russian Federation; James Ritter, 44856 Vista Del Sol, Fremont, Calif. 94539; Leonid Velikuv, 1371 Greenbrier Rd., San Carlos, Calif. 94070

[21] Appl. No.: 09/109,152

[22] Filed: Jul. 2, 1998

[51] Int. Cl.[7] ..... H01J 27/02

[52] U.S. Cl. ..... 250/423 R; 315/111.21

[58] Field of Search ..... 250/282, 492.21, 250/492.22, 492.23, 423 R; 315/111.21

[56] References Cited

U.S. PATENT DOCUMENTS

| | | | |
|---|---|---|---|
| 4,122,347 | 10/1978 | Kovalsky et al. . | |
| 4,538,067 | 8/1985 | Cuomo et al. | 250/396 |
| 4,652,795 | 3/1987 | Lee et al. | 315/111.41 |
| 4,684,848 | 8/1987 | Kaufman et al. | 315/111.81 |
| 4,710,283 | 12/1987 | Singh et al. . | |
| 5,889,371 | 3/1999 | Boyarsky et al. | 315/111.81 |

FOREIGN PATENT DOCUMENTS 2030807 3/1995 Russian Federation .

*Primary Examiner*—Edward P. Westin
*Assistant Examiner*—John Patti
*Attorney, Agent, or Firm*—Iyla Zborovsky

[57] ABSTRACT

A universal cold-cathode type ion source with closed-loop electron drifting and with ion-beam propagation direction perpendicular to the plane of electron drifting is intended for uniformly treating stationary or moveable objects. Treatment procedures include cleaning, activation, polishing, thin-film coating, or etching. The ion source of the invention allows for adjusting beam parameters and configurations and has an adjustable dimensions of the ionization space between the anode and the cathode. In a preferred embodiment, the adjustment is carried out by moving the anode with respect to the cathode. The moveable anode is shifted in the direction of propagation of the ion beam or in the opposite direction, whereby the tubular ion beam is either converged or diverged. As a result, it becomes possible to adjust the surface area being treated and characteristics of the ion beam such as average energy of ions in the beam and composition of the beam, in case of a multiple-component working medium.

16 Claims, 7 Drawing Sheets

UNIVERSAL COLD-CATHODE TYPE ION SOURCE WITH CLOSED-LOOP ELECTRON DRIFTING AND ADJUSTABLE IONIZATION GAP

FIELD OF THE INVENTION

The present invention relates to ion-emission technique, particularly to cold-cathode ion sources used for cleaning, activation, polishing, or thin-film coating of surfaces. More specifically, the invention relates to a universal cold-cathode type ion source with ion-beam propagation direction perpendicular to the plane of electron drifting. The source is intended for treating objects of different configurations and with large surface areas.

BACKGROUND OF THE INVENTION AND DESCRIPTION OF THE PRIOR ART

An ion source is a device that ionizes gas molecules and then focuses, accelerates, and emits them as a narrow beam. This beam is then used for various technical and technological purposes such as cleaning, activation, polishing, thin-film coating, or etching.

An example of an ion source is the so-called Kaufman ion source, also known as a Kaufman ion engine or an electron-bombardment ion source described by Kaufman H. R. in: An ion Rocket with an Electron-Bombardment Ion Source, NASA Technical Note, TND-585, Jan. 1961.

This ion source consists of a discharge chamber in which a plasma is formed, and an ion-optical system which generates and accelerates an ion beam to an appropriate level of energy. A working medium is supplied to the discharge chamber which contains a hot cathode that functions as a source of electrons and is used for firing and maintaining a gas discharge. The plasma, which is formed in the discharge chamber, acts as an emitter of ions and creates, in the vicinity of the ion-optical system, an ion-emitting surface. As a result, the ion-optical system extracts ions from the aforementioned ion-emitting surface, accelerates them to a required energy level, and forms an ion beam of a required configuration. Typically, aforementioned ion sources utilize two-grid or three-grid ion-optical systems. A disadvantage of such a device is that it is not suitable for treating large surfaces. Another disadvantage is that the ion beam has low intensity.

Attempts have been made to provide ion sources with ion beams of higher intensity by holding the electrons in a closed space between a cathode and an anode where the electrons could be held. For example, U.S. Pat. No. 4,122,347 issued in 1978 to Kovalsky et al. describes an ion source with a closed-loop of electrons for ion-beam etching and deposition of thin films, wherein the ions are taken from the boundaries of a plasma formed in a gas-discharge chamber with a hot cathode. The ion beam is intensified by a flow of electrons which is held in crossed electrical and magnetic fields within the accelerating space and which compensates for the positive spatial charge of the ion beam.

A disadvantage of the devices of such type is that it does not allow formation of ion beams of chemically-active substances for ion beams capable of treating large surface areas. Other disadvantages of the aforementioned device are short service life and high non-uniformity of ion beams.

U.S. Pat. No. 4,710,283 issued in 1997 to Singh et al. describes a cold-cathode type ion source with crossed electric and magnetic fields for ionization of a working substance wherein entrapment of electrons and generation of the ion beam are performed with the use of a grid-like electrode. This source is advantageous in that it forms belt-like and tubular ion beams emitted in one or two opposite directions.

However, the ion source with a grid-like electrode of the type disclosed in U.S. Pat. No. 4,710,283 has a number of disadvantages consisting in that the grid-like electrode makes it difficult to produce an extended ion beam and in that the ion beam is additionally contaminated as a result of sputtering of the material from the surface of the grid-like electrode. Furthermore, with the lapse of time the grid-like electrode is deformed whereby the service life of the ion source as a whole is shortened.

Other publications (e.g., Kaufman H. R. et al. (End Hall Ion Source, J. Vac. Sci. Technol., Vol. 5, Jul/Aug., 1987, pp. 2081–2084; Wykoff C. A. et al., 50-cm Linear Gridless Source, Eighth International Vacuum Web Coating Conference, Nov. 6–8, 1994)) disclose an ion source that forms conical or belt-like ion beams in crossed electrical and magnetic fields. The device consists of a cathode, a hollow anode with a conical opening, a system for the supply of a working gas, a magnetic system, a source of electric supply, and a source of electrons with a hot cathode. A disadvantage of this device is that it requires the use of a source of electrons with a hot or hollow cathode and that it has electrons of low energy level in the zone of ionization of the working substance. These features create limitations for using chemically-active working substances. Furthermore, a ratio of the emission slit width to a cathode-anode distance is significantly greater than 1, and this decreases the energy of electrons in the charge gap, and hence, hinders ionization of the working substance. Configuration of the electrodes used in the ion beam of such sources leads to a significant divergence of the ion beam. As a result, the electron beam cannot be delivered to a distant object and is to a greater degree subject to contamination with the material of the electrode. In other words, the device described in the aforementioned literature is extremely limited in its capacity to create an extended uniform belt-like ion beam. For example, at a distance of 36 cm from the point of emission, the beam uniformity did not exceed ±7%.

Russian Patent No. 2,030,807 issued in 1995 to M. Parfenyonok, et al. describes an ion source that comprises a magnetoconductive housing used as a cathode having a ion-emitting slit, an anode arranged in the housing symmetrically with respect to the emitting slit, a magnetomotance source, a working gas supply system, and a source of electric power supply.

FIGS. 1 and 2 schematically illustrate aforementioned known ion source with a circular ion-beam emission slit. More specifically, FIG. 1 is a sectional side view of an ion-beam source with a circular ion-beam emission slit, and FIG. 2 is a sectional plan view along line II—II of FIG. 1.

The ion source of FIGS. 1 and 2 has a hollow cylindrical housing 40 made of a magnetoconductive material such as Armco steel (a type of a mild steel), which is used as a cathode. Cathode 40 has a cylindrical side wall 42, a closed flat bottom 44 and a flat top side 46 with a circular ion-emitting slit 52.

A working gas supply hole 53 is formed in flat bottom 44. Flat top side 46 functions as an accelerating electrode. Placed inside the interior of hollow cylindrical housing 40 between bottom 44 and top side 46 is a magnetic system which includes a cylindrical permanent magnet 66 with poles N and S of opposite polarity. An N-pole faces flat top side 46 and S-pole faces bottom side 44 of the ion source. The purpose of the magnetic system with a closed magnetic circuit formed by parts 66, 40, 42, and 44 is to induce a magnetic field in ion emission slit 52. It is understood that this magnetic system is shown only as an example and that it can be formed in a manner described, e.g., in aforementioned U.S. Pat. No. 4,122,347. A circular annular-shaped anode 54 which is connected to a positive pole 56*a* of an electric power source 56 is arranged in the interior of housing 40 around magnet 66 and concentric thereto. Anode 54 is fixed inside housing 40 by means of a ring 48 made of non-magnetic dielectric material such as ceramic. Anode 54 has a central opening 55 in which aforementioned permanent magnet 66 is installed with a gap between the outer surface of the magnet and the inner wall of opening 55. A negative pole 56*b* of electric power source is connected to housing 40 which is grounded at GR.

Located above housing 40 of the ion source of FIGS. 1 and 2 is a sealed vacuum chamber 57 which has an evacuation port 59 connected to a source of vacuum (not shown). An object OB to be treated is supported within chamber 57 above ion-emitting slit 52, e.g., by gluing it to an insulator block 61 rigidly attached to the housing of vacuum chamber 57 by a bolt 63 but so that object OB remains electrically and magnetically isolated from the housing of vacuum chamber 57. However, object OB is electrically connected via a line 56*c* to negative pole 56*b* of power source 56. Since the interior of housing 40 communicates with the interior of vacuum chamber 57, all lines that electrically connect power source 56 with anode 54 and object OB should pass into the interior of housing 40 and vacuum chamber 57 via conventional commercially-produced electrical feedthrough devices which allow electrical connections with parts and mechanisms of sealed chambers without violation of their sealing conditions. In FIG. 1, these feedthrough devices are shown schematically and designated by reference numerals 40*a* and 57*a*. Reference numeral 57*b* designates a seal for sealing connection of vacuum chamber 57 to housing 40.

The known ion source of the type shown in FIGS. 1 and 2 is intended for the formation of a unilaterally directed tubular ion beam. The source of FIGS. 1 and 2 forms a tubular ion beam IB emitted in the direction of arrow A and operates as follows.

Vacuum chamber 57 is evacuated, and a working gas is fed into the interior of housing 40 of the ion source. A magnetic field is generated by magnet 66 in the accelerating gap between anode 54 and cathode 40, whereby electrons begin to drift in a closed path within the crossed electrical and magnetic fields. A plasma 58 is formed between anode 54 and cathode 40. When the working gas is passed through the ionization gap, tubular ion beam IB, which is propagated in the axial direction of the ion source shown by an arrow A, is formed in the area of an emission slit 52 and in an accelerating gap 52*a* between anode 54 and cathode 40.

The diameter of the tubular ion beam formed by means of such an ion source may reach 500 mm and more.

The ion source of the type shown in FIG. 1 is not limited to a rectangular configuration and may have an elliptical or an oval-shaped cross section as shown in FIG. 3. In this case the respective parts, i.e., side walls of the cathode $\mathbf{40}_{ov}$, a magnet $\mathbf{66}_{ov}$, and an anode $\mathbf{54}_{ov}$ will have an-oval shaped cross-section shown in FIG. 3 and will form an oval-shaped ion-emitting slit $\mathbf{52}_{ov}$. In FIG. 3 the parts of the ion beam source that correspond to similar parts of the previous embodiment are designated by the same reference numerals with an addition of subscript OV. Structurally, this ion source is the same as the one shown in FIG. 1 with the exception that a cathode $\mathbf{40}_{ov}$, anode $\mathbf{54}_{ov}$, a magnet $\mathbf{66}_{ov}$, and hence an emitting slit (not shown in FIG. 3), have an oval-shaped configuration. As a result, a belt-like ion beam having a width of up to 1400 mm can be formed. Such an ion beam source is suitable for treating large-surface objects when these objects are passed over ion beam IB emitted through emitting slit 52.

With 1 to 3 kV voltage on the anode and various working gases, this source makes it possible to obtain ion beams with currents of 0.5 to 1A. In this case, an average ion energy is within 400 to 1500 eV, and a nonuniformity of treatment over the entire width of a 1400 mm-wide object does not exceed ±5%.

Nevertheless, the aforementioned belt-type ion source has limited dimensions and is unsuitable for uniformly treating stationary objects of large surface areas. Furthermore, it does not allow simultaneous treatment of an object from different sides with a plurality of beams controlled simultaneously or individually. It cannot form extended ion beams of different configurations, such as converging or diverging ion beams, nor can it form several ion beams at the same time, and does not allow adjustment of ion beams to form beams of different configurations.

OBJECTS OF THE INVENTION

It is an object of the invention to provide an ion source with a closed-loop configuration of the ion-emitting slit which allows for adjusting geometry of the ionization space in the ion source.

Another object is to provide an ion source of the aforementioned type which may produce ion beams of different configurations.

Another object of the invention is to provide an ion source of the aforementioned type which allows for treating objects with different surface areas.

Another object is to provide an ion beam source of the aforementioned type which allows for adjusting an average energy and other characteristics of the ion beam.

Another object is to provide an ion beam source of the aforementioned type which allows for adjusting the composition of the ion beam, in case of a multiple-component gas used as a working medium.

BRIEF DESCRIPTION OF THE DRAWINGS

FIG. 7 is the same cross-sectional view as in FIG. 4 illustrating a circular configuration of the ion-emitting slit.

FIG. 8 is a view similar to FIG. 7 illustrating an oval shaped configuration of an ion-emitting slit.

SUMMARY OF THE INVENTION

A universal cold-cathode type ion source with closed-loop electron drifting and with ion-beam propagation direction perpendicular to the plane of electron drifting is intended for uniformly treating stationary or moveable objects. Treatment procedures include cleaning, activation, polishing, thin-film coating, or etching. The ion source of the invention allows for adjusting beam parameters and configurations and has an adjustable thickness of the ionization space between the anode and the cathode. In a preferred embodiment, the adjustment is carried out by moving the anode with respect to the cathode. The moveable anode is shifted in the direction of propagation of the ion beam or in the opposite direction, whereby the tubular ion beam is either converged or diverged. As a result, it becomes possible to adjust the surface area being treated and characteristics of the ion beam such an average energy of ions in the beam and composition of the beam, in case of a multiple-component working medium.

DETAILED DESCRIPTION OF THE INVENTION

Figure 4:
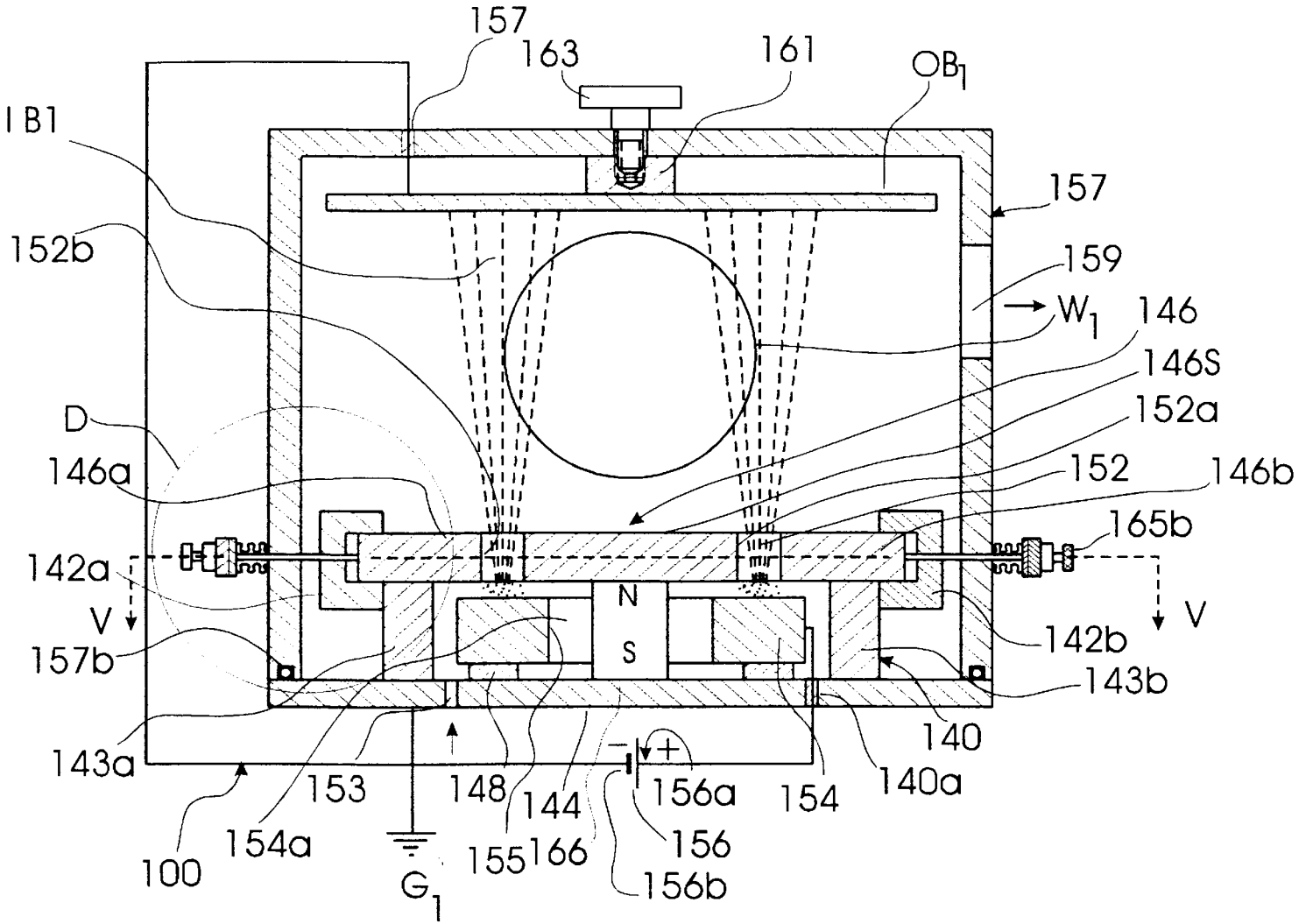
FIG. 4 is a sectional side view of an ion-beam source according to an embodiment of the invention with anode moveable with respect to cathode.

FIGS. 4 to 8——Ion-Beam Source with Anode Moveable with Respect to Cathode FIG. 4 is a sectional side view of an ion-beam source according to an embodiment of the invention in which the geometrical dimensions of the ion-emitting space are adjusted by shifting a moveable anode with respect to the cathode in the direction of propagation of the ion beam or in the opposite direction.

Figure 2:
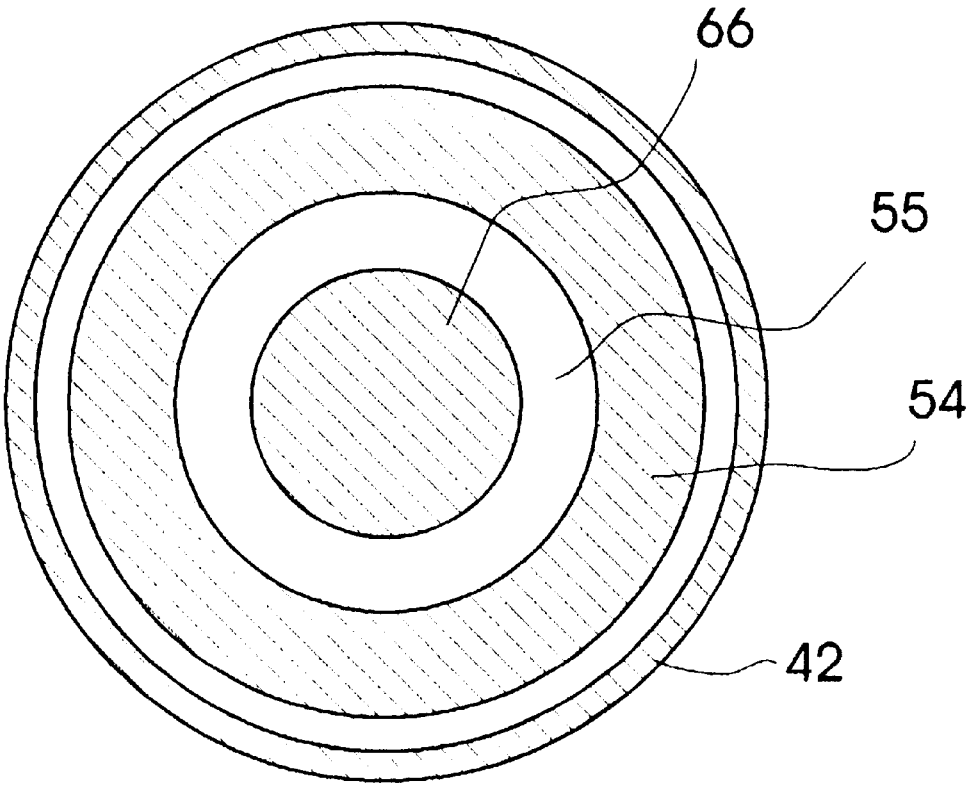
FIG. 2. PRIOR ART
FIG. 2 is a sectional plan view along line II—II of FIG. 1.
Figure 3:
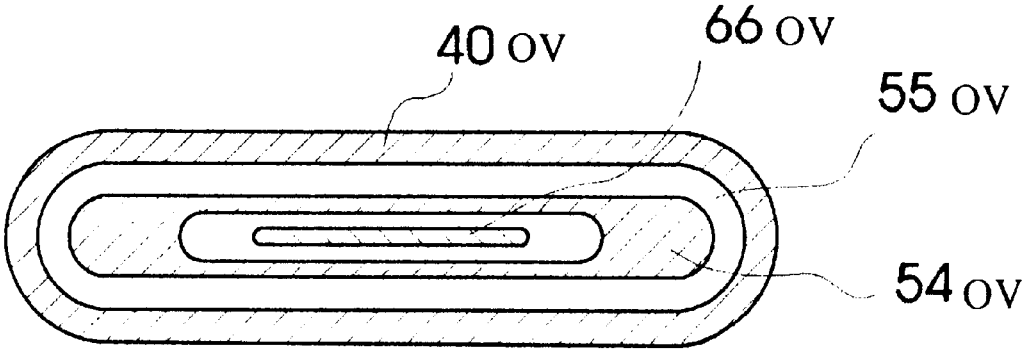
FIG. 3. PRIOR ART
FIG. 3 is a sectional plan view similar to the one of FIG. 2, but with an oval-shaped sectional configuration of the ion-beam emitting slit.

To some extent, the ion-beam source 100 of this embodiment is similar to the known ion source with a circular ion-beam emission slit of the type shown and described in connection with FIGS. 1, 2, and 3. The parts and units of ion-beam source 100 similar to those of FIGS. 1 through 3 will be designated by the same reference numerals with an addition of 100. Thus, ion source 100 has a hollow rectangular housing 140 made of a magnetoconductive material such as Armco steel which is used as a cathode. In the illustrated embodiment housing 140 has a substantially rectangular top-view configuration (FIG. 4A) with side walls 143*a,* 143*b,* a closed flat bottom 144, and a flat top side 146 with a closed-loop ion-emitting slit 152. This slit has a predetermined shape and geometric dimensions which will be described later in connection with FIGS. 4A, 7 and 8.

A working gas supply hole 153 is formed in bottom wall 144. Flat top side 146 functions as an accelerating electrode. Placed inside the interior of hollow cylindrical housing 140 between bottom 144 and top side 146 is a magnetic system which includes a permanent magnet 166 with poles N and S of opposite polarity. The N-pole faces flat top side 146 and the S-pole faces bottom side 144 of the ion source. In the illustrated embodiment, magnet 166 is rigidly fixed between top side 146 and bottom 144. The purpose of the magnetic system with a closed magnetic circuit formed by parts 166, 140, 152, and 144 is to induce a magnetic field in ion emission slit 152. It is understood that this magnetic system is shown only as an example and that it can be formed in a different manner, e.g., as in aforementioned U.S. Pat. No. 4,122,347. A closed-loop anode 154 which is connected to a positive pole 156*a* of an electric power source 156 is arranged in the interior of housing 140 around magnet 166 and concentrically thereto. Anode 154 is moveably supported inside housing 140 by means of an ionization-gap adjusting mechanism which will be described later. Anode 154 has a central opening 155 in which permanent magnet 166 is installed with a gap between the outer surface of the magnet and the inner wall of opening 155. A negative pole 156*b* of electric power source 156 is connected to housing 140 which is grounded at $G_1$.

Located above housing 140 of the ion source of FIGS. 4 is a sealed vacuum chamber 157 which has an evacuation port 159 connected to a source of vacuum (not shown). An object OB, to be treated is supported within chamber 157 above ion-emitting slit 152, e.g., by gluing it to an block 161 rigidly attached to the housing of vacuum chamber 157 by a bolt 163. However, object $OB_1$ is electrically connected via a line 159*a* to negative pole 156*b* of power source 156. Since the interior of housing 140 communicates with the interior of vacuum chamber 157, all lines that electrically connect power source 156 with anode 154 and object $OB_1$ should pass into the interior of housing 140 and vacuum chamber 157 via conventional electrical feedthrough devices 140*a,* 140*b.*

Figure 1:
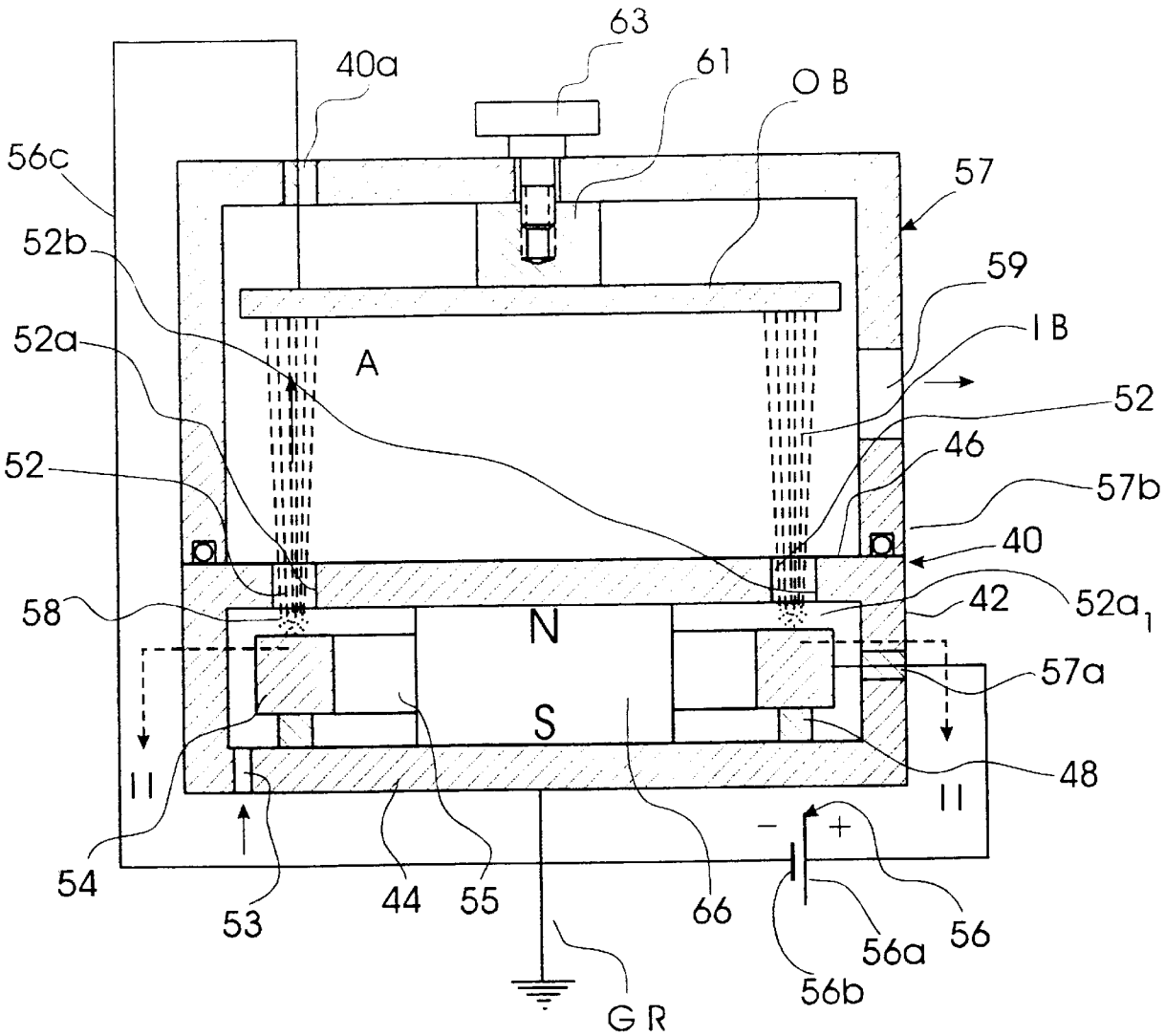
FIG. 1 PRIOR ART
FIG. 1 is a sectional side view of a known ion-beam source with a circular ion-beam emission slit.

To this point, the apparatus of FIG. 4 was identical to that of FIG. 1. However, an essential distinctive feature of ion-beam source 100 of FIG. 4 is that its anode 154 is moveable with respect to cathode 140.

In this ion beam source, anode 154 can be shifted with respect to cathode 140 in the beam-propagation direction shown by an arrow A1, or in the opposite direction. In this connection, anode 154 is supported by a block 148 of a non-magnetic dielectric material which may be glued to the lower side of anode 154. In the illustrated embodiment, heads 149*a,* 149*b* of rods 151*a,* 151*b* are rigidly fixed, e.g., embedded, in the material of block 148, and the ends of rods 151*a,* 151*b* pass with a sliding fit through respective guide openings 144*a* and 144*b* in bottom wall 144 of cathode housing 140 and via appropriate feedthrough mechanisms. These feedthrough devices, which are known as manual linear feedthrough devices, are commercially produced, e.g., by Huntington Mechanical Laboratories, Inc., Mountain View, Calif. In the present embodiment of the invention, such feed through devices consist of a bellows 157*a* and 157*b.* One end of each bellows is sealingly connected to bottom 144 of hollow housing 140 and the other end to respective rods 151*a* and 151*b.* Reference numeral 157*c* designates a seal for sealing connection of vacuum chamber 157 to housing 140.

Guide openings 144*a* and 144*b* guide rods 151*a* and 151*b* and hence anode 154 during its movement with respect to the cathode.

The ends of rods 151*a,* 151*b* are connected to a cross member 149*c* with a threaded opening 149*d.* An adjustment screw 180, with a smooth portion 182 rotationally supported by a stationary bearing support 184, has its threaded end engaged with threaded opening 149*d* of cross member 149*c.* Screw 180 has a handle 186 rigidly attached thereto.

Rotation of handle 186 causes engagement of adjustment screw 180 with threaded opening 149*d* of cross member 149*c.* As a result, cross member 149*c* moves with respect to cathode 140 in the direction of ion beam propagation shown by arrow A1 or in the opposite direction. These movements change strength of an electrical field in an ionization and ion acceleration space or gap 158 (the anode-cathode distance).

Figure 4A:
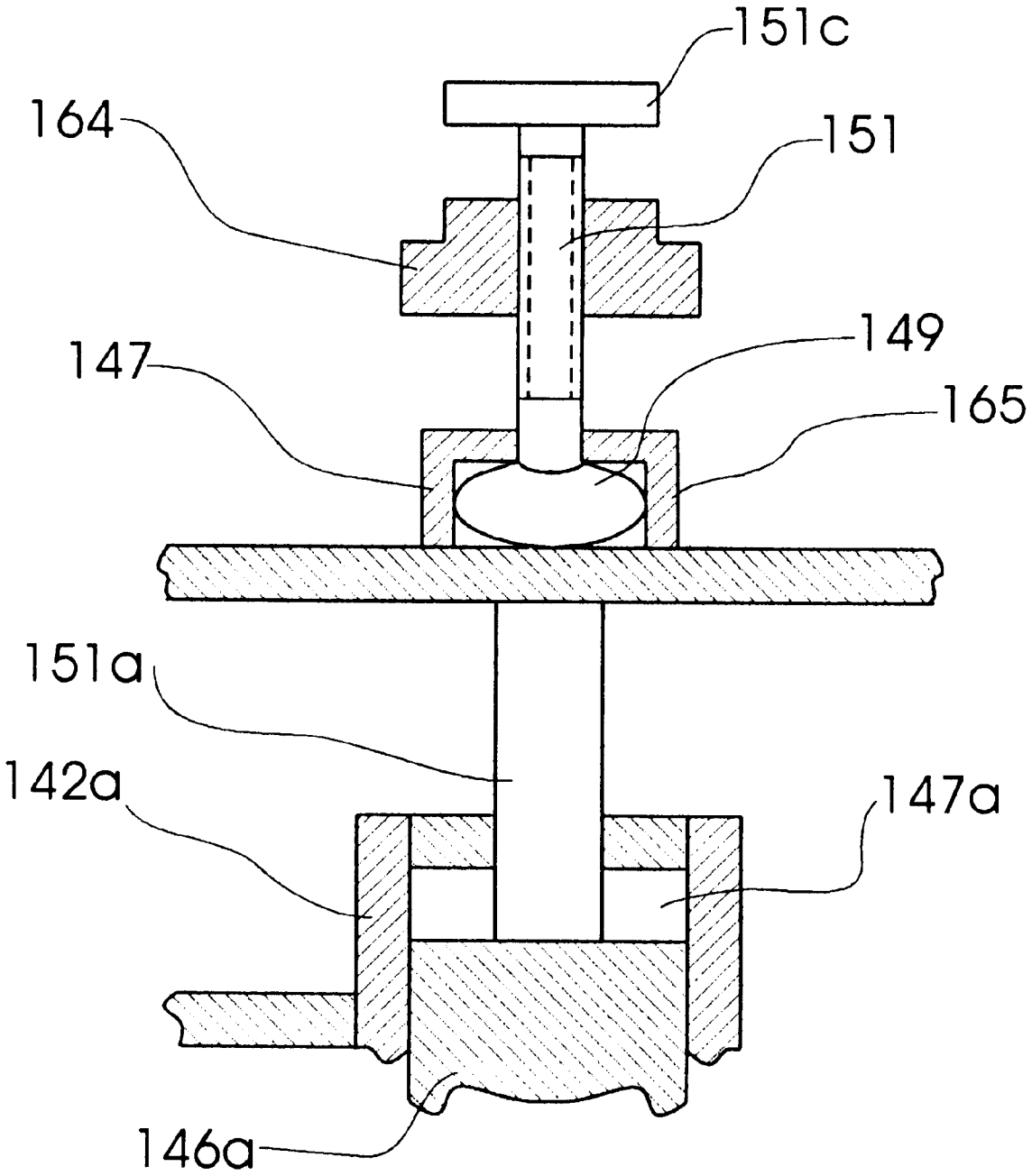
FIG. 4A is a sectional view along line IVA—IVA of FIG. 4, illustrating the shape of the anode, permanent magnet, and hollow housing.

As shown in FIG. 4A, which is a sectional view of along line IVA–IVA of FIG. 4, the ion source of FIG. 4 has a substantially rectangular cross-sectional configuration. In other words, in this case the respective parts, i.e., side walls of the cathode $\mathbf{140}_{rec}$, a magnet $\mathbf{166}_{rec}$, and an anode $\mathbf{154}_{rec}$ will have a substantially rectangular cross-section shown in FIG. 4A and will form a substantially rectangular ion-emitting slit $\mathbf{157}_{rec}$.

Figure 5:
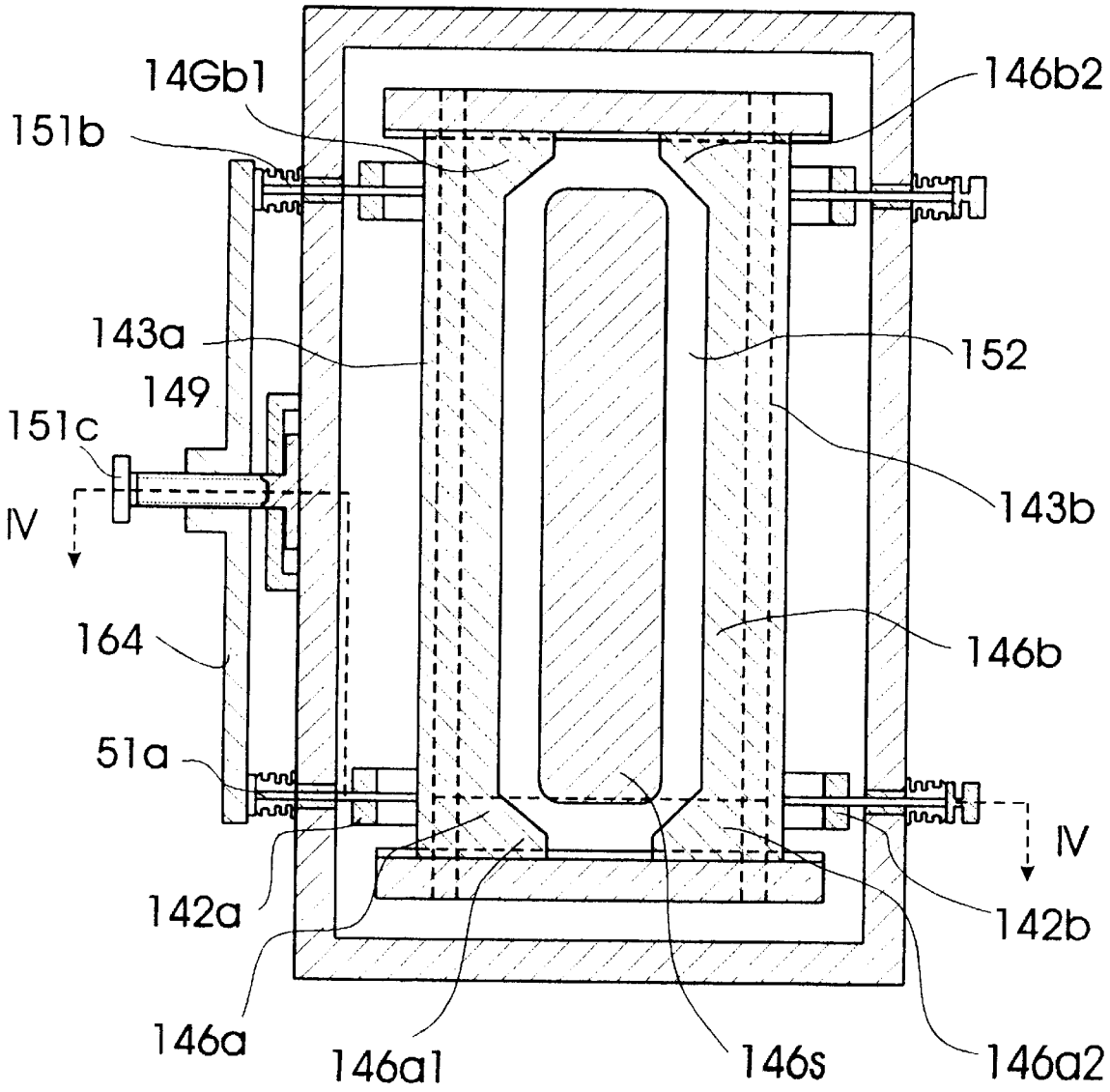
FIG. 5 is a fragmental sectional view of the ion source of FIG. 4 with anode shifted further away from the cathode for converging the ion beam.
Figure 6:
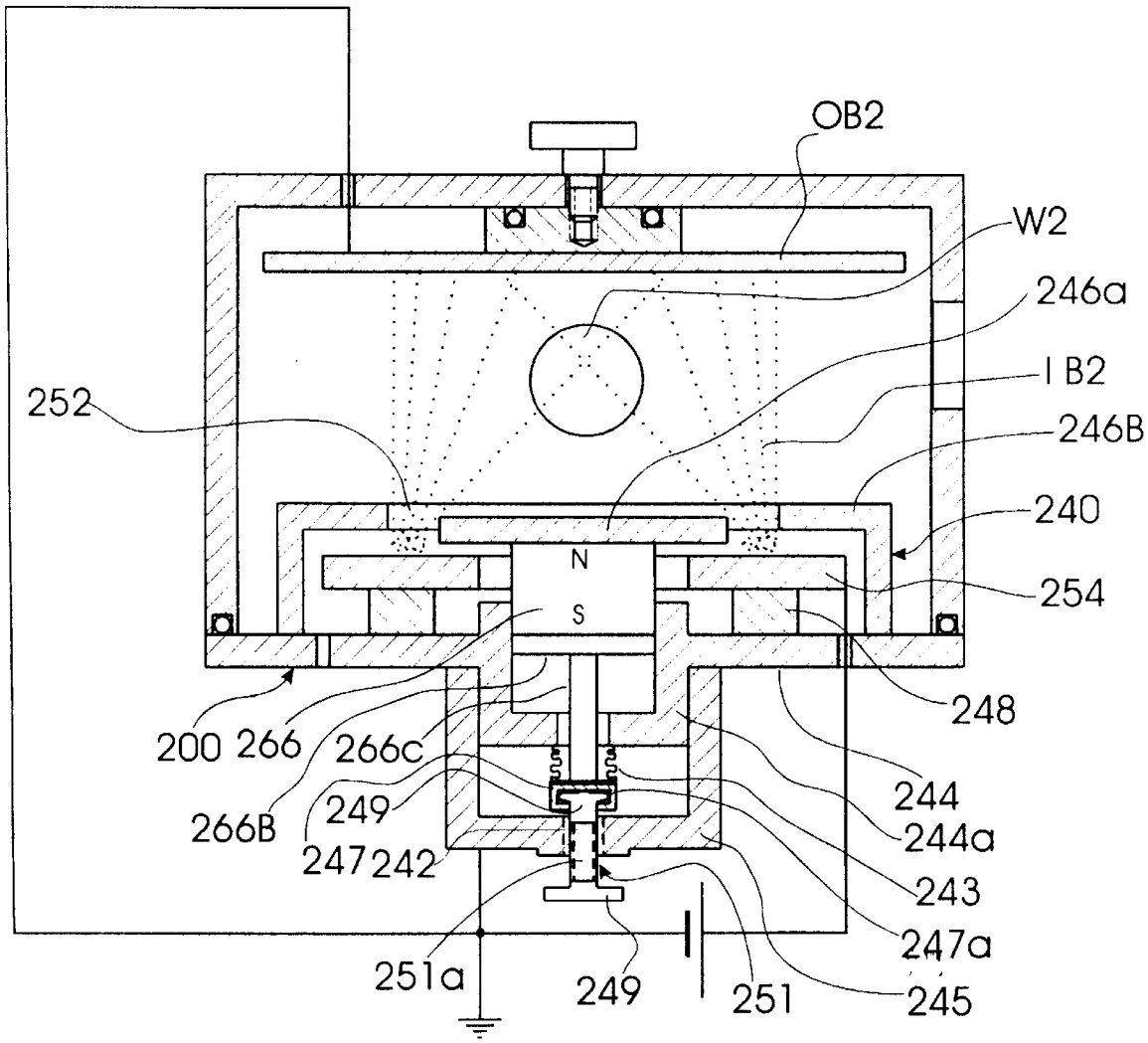
FIG. 6 is a fragmental sectional view of the ion source of FIG. 4 with anode shifted closer to the cathode for diverging the ion beam.
Figure 6A:
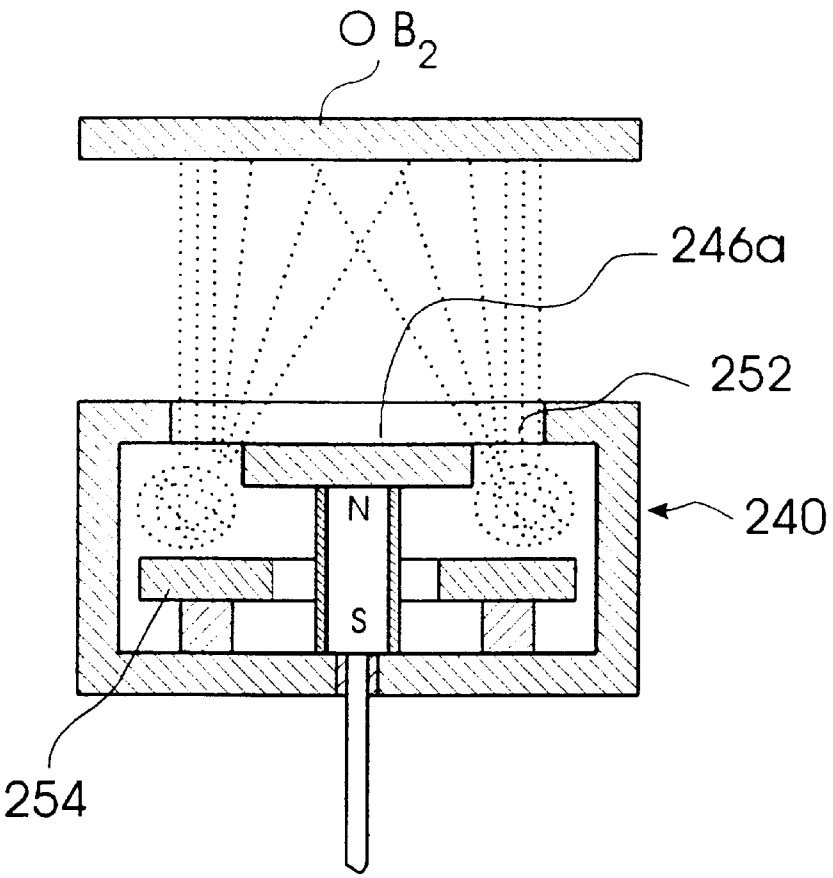
Figure 6B:
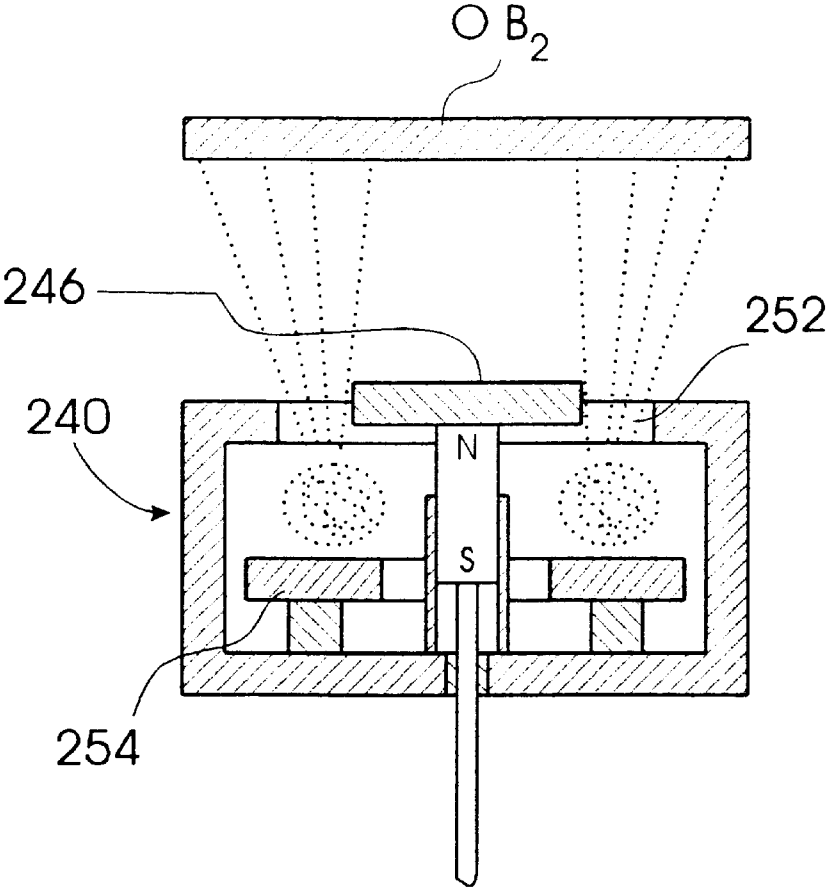

FIG. 5 is a fragmental sectional view of the ion source of FIG. 4 with anode shifted further away from the cathode for converging the ion beam. FIG. 6 is a fragmental sectional view of the ion source of FIG. 4 with anode shifted closer to the cathode for diverging the ion beam.

When ionization gap 158 is increased, which is shown in FIG. 5, the electrical strength of accelerating gap 158 decreases, and when the aforementioned distance is reduced, the electrical strength increases.

It is understood that the construction with the cross member is given as an example and that the anode adjustment mechanism may be made in the form of a single screw, or the like. In any case, this mechanism consists of two parts. One part is connected to moveable anode 154 and is located inside the sealed housing 140 of ion source 100. Another part, is rigidly connected to the first part and protrudes outside the source housing via a sealed feedthrough mechanism to ensure easy adjustment of ionization and ion-acceleration gap 158.

Vacuum chamber 157 has a sealed transparent window W2 for observing the position and configuration of ion beam IB1 when the adjustment is carried out in the working state of ion source 100.

FIG. 7 is a cross-sectional view of the ion source similar to that of FIG. 4 illustrating a circular configuration of ion-emitting slit 152 and hence of anode 154 itself. In this case, the respective parts, i.e., side wall of the cathode $\mathbf{140}_{cr}$, a magnet $\mathbf{166}_{cr}$, and an anode $\mathbf{154}_{cr}$ will have a circular cross-section shown in FIG. 7 and will form a circular ion-emitting slit $\mathbf{155}_{cr}$.

FIG. 8 is a view similar to FIG. 7 illustrating an oval shaped configuration of ion-emitting slit 152*a* and anode 154*a*. In this case, the respective parts, i.e., side wall of the cathode $\mathbf{140}_{ov}$, a magnet $\mathbf{166}_{ov}$, and an anode $\mathbf{154}_{ov}$ will have a circular cross-section shown in FIG. 8 and will form a circular ion-emitting slit $\mathbf{155}_{ov}$.

Thus it has been shown that the present invention provides a universal cold-cathode type ion source with closed-loop electron drifting which allows for adjusting geometrical dimensions of the ion-generating space, produces ion beams of different configurations, allows for treating objects with different surface areas, allows for adjusting an average energy of ions on the beam and of the composition of the ion beam, in case of a multiple-component gas used as a working medium.

Although the invention has been shown in the form of a specific embodiments, it is understood that these embodiments were given only as examples and that any changes and modifications are possible, provided they do not depart from the scope of the appended claims. For example, the cathode housings of ion sources, as well as ion-emitting slits, and anodes may have other than rectangular, elliptic, or any other closed-loop configuration. Moveable anode can be moved by means of a programmable pulse linear motor mechanism, hydraulic cylinder-piston unit, or any other suitable mechanism of linear displacement. The objects to be treated may be fixed by bolts which, at the same time, may be used for grounding the objects. Working media may comprise different gases or their combinations. The objects to be treated may be different in shape and dimensions and may be subjected to different sequence of treatment. If necessary, a moveable cathode can be shifted with respect to a stationary anode.

What we claim is:

1. A universal ion beam source with a closed-loop ion-emitting slit capable of emitting an ion beam toward an object located in a position reachable by said ion beam, comprising:

hollow housing means that function as a cathode of said ion beam source;

anode means located in said hollow housing means and spaced from said cathode at an anode-cathode distance to form an ionization gap therebetween for ionization and acceleration of ions formed in said gap during operation of said ion beam source;

magnetic field generating means in mangetoconductive relationship with said anode means and said cathode for forming a closed magnetoconductive circuit passing through said anode means, said ionization gap, said cathode, and said magnetic field generating means;

a closed-loop ion-emitting slit formed in said cathode in the path of said magnetoconductive circuit, said closed-loop ion-emitting slit having predetermined geometric dimensions;

electric power supply means for maintaining said anode means under a positive charge and said cathode under a negative charge;

means for the supply of a working medium into said hollow housing of said cathode means to form an ion beam when said working medium passes through said ionization gap, said beam having a direction of propagation towards said object; and means for moving said anode with respect to said cathode in said direction of propagation for adjusting said anode-cathode distance and thus adjusting said performance characteristics of said ion beam source.

2. The universal ion beam source of claim 1, wherein said means for moving said anode means with respect to said cathode comprise a linear displacement mechanism.

3. The universal ion beam source of claim 2, wherein said linear displacement mechanism comprises a first member which is rigidly connected to said anode means and a second member which is rigidly connected to said first member and protrudes outside said hollow housing; said hollow housing having a sealed linear feedthrough, said second member protruding outside said hollow housing via said sealed linear feedthrough, said hollow housing having means for guiding said second member.

4. The universal ion beam source of claim 3, wherein: said magnetic field generating means has a permanent magnet which generates a magnetic field that passes through said ion-emitting slit.

5. The universal ion beam source of claim 4, wherein: said permanent magnet which is rigidly fixed in said hollow housing; said anode means having a through opening into which said permanent magnet is inserted without contact with the walls of said opening for unobstructed movement with respect thereto.

6. The universal ion beam source of claim 5, further comprising: an anode support made of a dielectric material to which said first member is rigidly attached, said second member being made in the form of at least one rod that is rigidly attached to said anode support at one end, and has a second end protruding outside said hollow housing via said feedthrough; and a linear movement drive means connected to said second end.

7. The universal ion beam source of claim 6, wherein said second end is connected to a nut with a thread and said linear movement drive means is a screw that engages said nut.

8. A universal ion beam source with a closed-loop ion-emitting slit capable of emitting an ion beam toward an object located in a position reachable by said ion beam, comprising:

hollow housing means that function as a cathode of said ion beam source;

anode of a closed-loop configuration located in said hollow housing means and spaced from said cathode at an anode-cathode distance to form an ionization gap therebetween for ionization and acceleration of ions formed in said gap during operation of said ion beam source;

a permanent magnet fixed in said hollow housing in magnetoconductive relationship with said anode and said cathode for forming a closed magnetoconductive circuit passing through said anode means, said ionization gap, said cathode, and said magnetic field generating means;

a closed-loop ion-emitting slit substantially of the same configuration as said anode, said slit being formed in said cathode in the path of said magnetoconductive circuit;

electric power supply means for maintaining said anode under a positive charge and said cathode under a negative charge;

means for the supply of a working medium into said hollow housing of said cathode means to form an ion beam when said working medium passes through said ionization gap, said beam having a direction of propagation towards said object; and means for moving said anode with respect to said cathode in said direction of propagation for adjusting said anode-cathode distance and thus adjusting said performance characteristics of said ion beam source, said means for moving said anode with respect to said cathode comprising a linear displacement mechanism.

9. The universal ion beam source of claim 8, wherein said linear displacement mechanism comprises a pair of rods each having one end connected to said anode and another end protruding outside through said hollow housing; said hollow housing having a pair of sealed linear feedthrough devices, said another end of each of said rod protruding outside said hollow housing via said sealed linear feedthrough, said hollow housing having guide openings, said rods passing through said guide openings with a sliding fit.

10. The universal ion beam source of claim 9, wherein: said anode having a through opening into which said permanent magnet is inserted without contact with the walls of said opening for unobstructed movement with respect thereto.

11. The universal ion beam source of claim 10, further comprising: an anode support made of a dielectric material to which said first one end of each of said rods is rigidly attached.

12. The universal ion beam source of claim 11, wherein said another end of each of said rods is connected to a nut with a thread and said linear movement drive means is a screw that engages said nut.

13. A method for adjusting performance characteristics of ion beam source with an ionization gap between an anode and a cathode and with a closed-loop ion emitting slit of predetermined geometric dimensions, said ion source having a predetermined direction of propagation of an ion beam, said method comprising the steps of:

providing said ion-beam source with means for adjusting said ionization gap; and adjusting performance characteristics of said ion beam by changing said ionization gap.

14. The method of claim 13, wherein said step of adjustment is performed by shifting said anode with respect to said cathode in said direction of propagation of an ion beam.

15. The method of claim 14, wherein said ion beam source has means for moving said anode with respect to said cathode in said direction of propagation for adjusting said ionization gap and thus adjusting said performance characteristics of said ion beam source.

16. The method of claim 15, wherein said means for moving said anode means with respect to said cathode comprise a linear displacement mechanism.

* * * * *